United States Patent [19]

Bray

[11] Patent Number: 5,068,920

[45] Date of Patent: Dec. 3, 1991

[54] DRY SUIT/WATER SPORT SUIT WITH REINFORCED SEAT

[75] Inventor: Robert D. Bray, Milwaukie, Oreg.

[73] Assignee: O. S. Systems, Incorporated, Scappoose, Oreg.

[21] Appl. No.: 642,810

[22] Filed: Jan. 18, 1991

[51] Int. Cl.[5] ..... A41D 13/00

[52] U.S. Cl. ..... 2/21 R; 2/2; 2/79; 2/82; 2/227

[58] Field of Search ..... 2/2.1 R, 2, 79, 82, 2/227

[56] References Cited

U.S. PATENT DOCUMENTS 4,276,341 6/1981 Tanaka ..... 2/2.1 R
4,907,295 3/1990 Yasuda ..... 2/2.1 R

FOREIGN PATENT DOCUMENTS 2361269 8/1976 France ..... 2/2.1 R

*Primary Examiner*—Werner H. Schroeder
*Assistant Examiner*—Gloria Hale
*Attorney, Agent, or Firm*—Klarquist, Sparkman, Campbell, Leigh & Whinston

[57] ABSTRACT

A water sport suit for barefoot water skiing is made of waterproof material and has a back portion including a seat portion of a nylon fabric having an interior coating of polyurethane. A heat and stress resistant patch of nylon 1 neoprene or nylon 2 neoprene is adhesively secured by a flexible waterproof neoprene cement to the seat portion of the suit over the entire area of the patch and is stitched to the seat portion at its perimeter.

7 Claims, 1 Drawing Sheet

FIG. 1
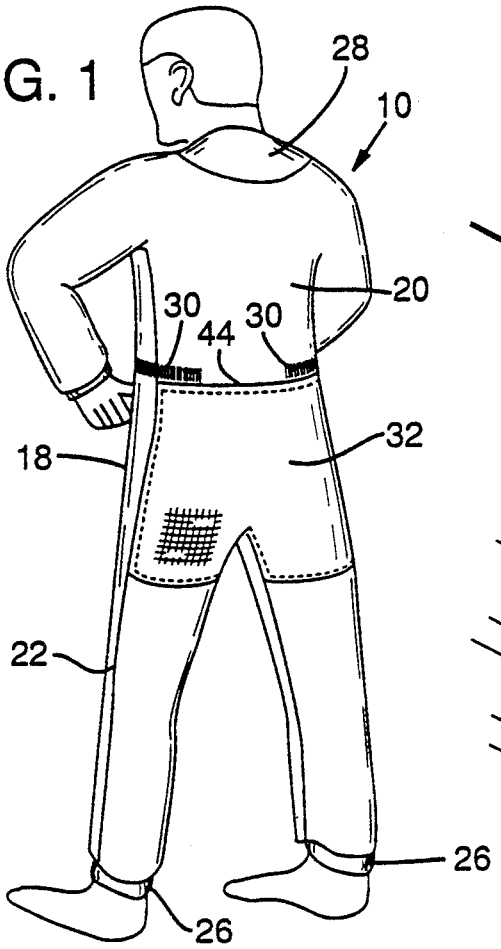
FIG. 2
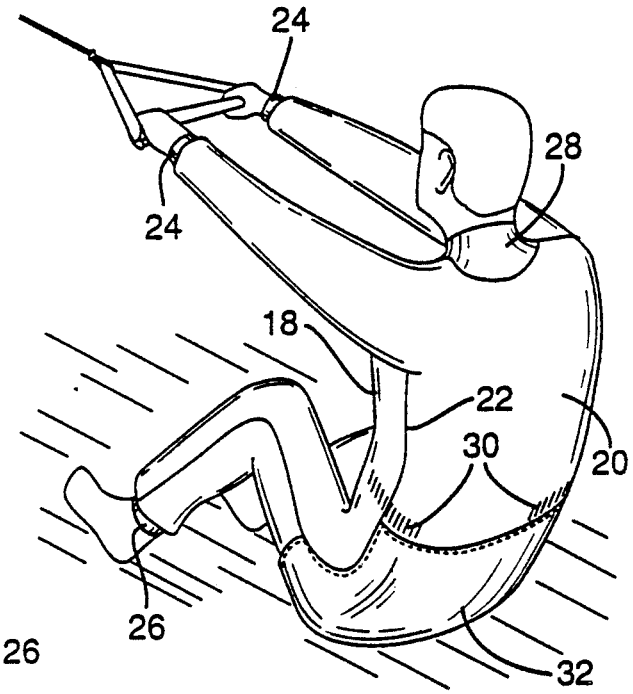
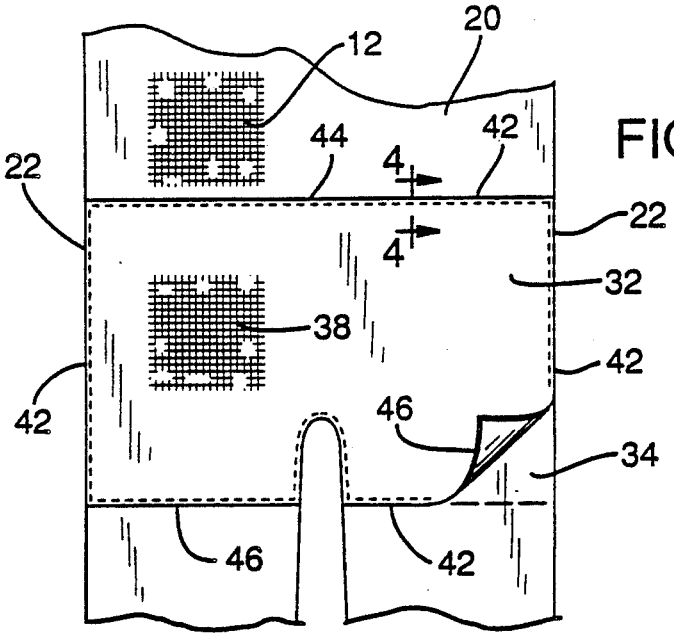
FIG. 3
FIG. 4
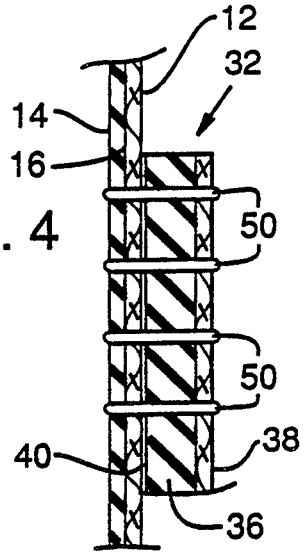

DRY SUIT/WATER SPORT SUIT WITH REINFORCED SEAT

BACKGROUND OF THE INVENTION

This invention relates to water sport suits known as "dry suits" and, more particularly, to water sport suits designed for barefoot water skiing.

Water sport suits include suits generally known as "wet suits" and "dry suits". Wet suits are suits made of thermally insulating rubberized material, generally closely-fitting to the body, and adapted so that a thin layer of water exists between the suit and the wearer's body. The suit once wet, does not exchange much water, thus the thin layer of water adjacent the wearer's body provides an insulating function.

Dry suits, in contradistinction to wet suits, are more effective in conserving body heat especially in cold water conditions. The dry suit is a relatively loose fitting, water tight suit, which may be worn over relatively heavy, thermally protective insulating underwear. An example of a dry suit is shown in U.S. Pat. No. 4,483,019.

Dry suits are often worn by water skiers in cold water conditions. They are also worn by water skiers who do what is known as "barefoot" skiing. In barefoot skiing the skier is pulled by a power boat with his back or buttocks in contact with the water until sufficient speed is achieved (thirty to sixty miles per hour) to permit him to stand erect, skimming the surface of the water on his bare feet.

Once erect, the skier may electively drop to a sitting position, hitting the water with his buttocks, whence he may spin or rotate on his buttocks and then pop back up to a standing position. Riding the water on the buttocks or striking the water with the buttocks when performing high-speed tricks or maneuvers has been found to be particularly damaging to the fabric of a dry suit, particularly in the seat portion thereof. (Webster's New World Dictionary, second college edition, 1972, defines "seat" as "the part of a garment covering the buttocks". The "seat portion" of a dry suit in this application will thus refer to that part of a dry suit which covers the buttocks.)

Dry suits are often made of a nylon fabric having an interior coating of polyurethane. When barefoot skiing at high speeds as above described, the force and friction of the water on the seat portion of the dry suit has been found to heat the fabric, literally destroying the physical properties of the nylon and the polyurethane coating. The heat generated during contact with the water literally melts and wrinkles the nylon, often delaminates the polyurethane coating, wrinkling the fabric and destroying the bond. Attempts to remedy the problem by reinforcing the seat portion of a dry suit with additional fabric of the same material as the basic suit have been found not to solve the problem.

Accordingly, it is a principal object of the present invention to provide a dry suit for barefoot water skiing that will be sufficiently heat and stress resistant in the seat portion thereof to stand up under the high speed conditions typically encountered.

It is a further object of the present invention to provide a dry suit for barefoot water skiing with a seat portion which is able to withstand the force of the water and the friction created thereby when the wearer performs high speed water-contacting maneuvers.

SUMMARY OF THE INVENTION

In accordance with the aforementioned objects, my water sport suit is made of waterproof material and has a back portion including a seat portion comprising an exterior nylon fabric having an interior coating of polyurethane. A heat and stress resistant patch is mounted on the exterior nylon fabric of the seat portion and entirely covers the same. The patch comprises a layer of neoprene having an exterior skin of nylon laminated thereto. The entire area of the patch is adhesively secured to the exterior nylon fabric of the seat portion of the suit. The patch is also stitched to the seat portion of the suit, but only at the perimeter of the patch.

Preferably, the patch comprises what is known as nylon 1 neoprene, wherein the neoprene comprises a 1.5 mm. layer. The fabric may comprise Lycra® spandex fiber. (Lycra® is a registered trademark of DuPont.

The neoprene layer of the patch is adhesively secured to the exterior nylon fabric of the seat portion of the suit by a flexible waterproof neoprene cement. In suits wherein the back portion is attached to the front portion at a pair of side seams, preferably the patch extends laterally of the back portion from one side seam to the other. In this case the patch is stitched to the seat portion of the back portion at the pair of side seams.

Other objects and advantages of the invention will be readily appreciated by reference to the following detailed description when considered in conjunction with the accompanying drawings.

DESCRIPTION OF THE DRAWINGS

FIG. 1 is a perspective view of the water sport suit taken from the rear;

FIG. 2 is a view of a barefoot skier in action wearing the suit;

FIG. 3 is a view of part of the pattern for the back portion of the suit showing the patch in place; and FIG. 4 is a sectional view to an enlarged scale taken on line 4—4 of FIG. 3.

DESCRIPTION OF THE PREFERRED EMBODIMENT

Referring to the drawings, the water sport suit 10 of the present invention is preferably made of a heat sealable, waterproof, exterior nylon fabric 12 having a 3 oz. per yard polyurethane coating 14 on the interior surface 16 thereof. The polyurethane coating 14 may be a polyether or a polyester coating.

Polyurethane coated nylon fabric suitable for this suit may comprise a 200 denier nylon oxford, a basketlike weave, with a 3 oz. per yard polyurethane backing, a 200 denier nylon twill weave with a 3 oz. per yard polyurethane backing, or a 210 denier nylon twill weave with a 3 oz. per yard polyurethane backing.

The suit 10 is formed using various patterned pieces, including a front portion 18 and a back portion 20 attached to the front portion 18 at least at a pair of side seams 22. The suit includes ankle and wrist guards 24, 26 and a neck piece 28, all of latex material, and has a bungie waist 30.

A heat and stress resistant patch 32 is mounted on the exterior nylon fabric 12 of the seat portion 34 of the suit and entirely covers the same. The patch 32 preferably is of nylon 1 neoprene, which is a 1.5 mm. layer 36 of neoprene having an exterior skin 38 of nylon or Lycra spandex fabric laminated thereto. The patch 32 is adhesively secured to the exterior nylon fabric 12 of the seat portion 34 by applying over the entire area of the neoprene layer 36 a flexible waterproof neoprene cement 40. The nylon or Lycra spandex skin 38 of the patch 32 is exterior of the suit. The patch 32 is also stitched to the seat portion 34 of the suit, but only around its perimeter 42, and preferably at the side seams 22.

Preferably, the patch 32 extends at its upper edge 44 to a point slightly below the bungie waist 30 and at its lower edge 46 to slightly below the gusset of the crotch 48 so as to extend down the legs. Adhesively securing the patch to the seat portion 34 and stitching it only at its perimeter 42 as above described provides a seamless surface which minimizes friction due to water contact. The stitching 50 at the side seams 22 and at the top and bottom edges 44, 46 of the patch is preferably made with quadruple interlocking stitches waterproofed as is well known in the art.

The neoprene layer 36 is a good insulating material, insulating the wearer's buttocks from the heat generated by friction with the water. The neoprene layer 36 also cushions the seat portion 34. This is a desirable feature, especially during high speed contact with the water. Adhesively securing the patch 32 to the exterior nylon fabric 12 of the suit over the entire area of the patch eliminates "grabbing" due to contact with the water which otherwise would cause a surface distortion of the patch. Nylon 1 neoprene is a stretchable fabric, and contact with water at high speed would cause a distortion of the patch—a "digging" of the water into the patch—if it were not adhesively attached to the seat portion over its entire area. Cementing the patch 32 as aforesaid and stitching it to the seat portion 34 of the suit only at its perimeter 42 thus minimize surface distortion. Securing the patch 32 to the suit in this manner also improves the resistance of the patch to water contact, minimizing such resistance. Securing the patch 32 in this manner also disperses the stress caused by the frictional contact over the entire water-contacting surface of the patch and increases its cushioning effect, thereby permitting use of a thinner neoprene layer 36 than would otherwise be the case.

Attaching the patch 32 in this manner also provides the patch with a firm foundation, yet ensures that the resulting garment is not too stiff or bulky. A tournament barefoot skier operating at high speed and wearing the suit of this invention can hit the water fast on his buttocks, spin around, and then pop back up onto his feet, totally under control, secure in the knowledge that the suit will withstand the heat and stress caused by the maneuver.

Although nylon 1 neoprene is a desirable fabric from which to make the patch, the patch 32 may also be made from nylon 2 neoprene, which is a neoprene layer having an exterior skin of nylon or Lycra spandex laminated to both sides. The Lycra spandex fabric on both sides adds strength to the patch. A nylon 2 neoprene patch 1.5 mm. thick is appropriate.

Although a preferred embodiment of the invention has been illustrated, obviously other embodiments and modifications may be made without departing from the spirit of the invention, and all such embodiments and modifications are intended to be included within the scope of the following claims:

I claim:

1. In a water sport suit made of waterproof material and having a back portion including a seat portion comprising an exterior nylon fabric having an interior coating of polyurethane, a heat and stress resistant patch mounted on the exterior nylon fabric of the seat portion of the suit and entirely covering the same, the patch comprising an interior layer of neoprene having an exterior skin of fabric laminated thereto, the entire area of the patch being adhesively secured to the exterior nylon fabric of the seat portion of the suit and the patch being stitched to the seat portion of the suit only at the perimeter of the patch.

2. The water sport suit of claim 1 wherein the patch comprises nylon fabric.

3. The water sport suit of claim 1 wherein the interior layer of neoprene comprises a 1.5 mm. layer of neoprene.

4. The water sport suit of claim 1 wherein the patch comprises spandex fiber.

5. The water sport suit of claim 1 wherein the patch is adhesively secured to the exterior nylon fabric of the seat portion of the suit by a flexible waterproof neoprene cement.

6. The water sport suit of claim 1 further comprising a front portion, the back portion being attached to the front portion at least at a pair of side seams, the patch extending laterally of the back portion from one side seam to the other.

7. The water sport suit of claim 6 wherein the patch is stitched to the seat portion of the back portion of the suit at the pair of side seams.

* * * * *